US006889405B2

(12) United States Patent
Ritrovato et al.

(10) Patent No.: US 6,889,405 B2
(45) Date of Patent: May 10, 2005

(54) DUAL MATERIAL TOOL HANDLE

(75) Inventors: Michael L. Ritrovato, Elizabethtown, PA (US); Karen Richwine, Mechanicsburg, PA (US)

(73) Assignee: Ames True Temper, Inc., Camp Hill, PA (US)

( * ) Notice: Subject to any disclaimer, the term of this patent is extended or adjusted under 35 U.S.C. 154(b) by 71 days.

(21) Appl. No.: 10/360,422

(22) Filed: Feb. 7, 2003

(65) Prior Publication Data

US 2004/0154132 A1 Aug. 12, 2004

(51) Int. Cl.[7] ..... B25G 3/00; B25G 1/04

(52) U.S. Cl. ..... 16/430; 16/436; 16/421; 16/DIG. 12; 15/143.1; 81/177.1; 81/489

(58) Field of Search ..... 16/430, 431, 436, 16/421, DIG. 12, DIG. 19; D8/10, 107, 303, 395; 30/335–339, 526, 527; 294/49, 55, 57; 81/177.1, 489; 15/143.1, 144.7, 167.1; 74/543, 551.1, 551.9; 172/371

(56) References Cited

U.S. PATENT DOCUMENTS

| | | | | | |
|---|---|---|---|---|---|
| 2,940,492 | A | * | 6/1960 | Curry et al. | 81/22 |
| 4,739,536 | A | * | 4/1988 | Bandera et al. | 16/430 |
| 4,934,024 | A | | 6/1990 | Sexton, I | |
| 5,261,665 | A | * | 11/1993 | Downey | 473/303 |
| 5,289,735 | A | | 3/1994 | Kato et al. | |
| 5,390,572 | A | * | 2/1995 | Gakhar et al. | 81/436 |
| 5,421,931 | A | * | 6/1995 | Carmien | 156/172 |
| 5,475,894 | A | * | 12/1995 | Wildforster | 16/430 |
| 5,511,445 | A | | 4/1996 | Hildebrandt | |
| 5,530,989 | A | * | 7/1996 | Remmert et al. | 16/430 |
| 5,623,999 | A | * | 4/1997 | Linsbauer et al. | 173/170 |
| 5,722,116 | A | * | 3/1998 | Lin | 16/436 |
| 5,740,586 | A | * | 4/1998 | Gomas | 16/436 |
| 5,797,165 | A | * | 8/1998 | Armbrust | 16/430 |
| 5,823,069 | A | * | 10/1998 | Roark et al. | 74/551.9 |
| 5,868,455 | A | | 2/1999 | Springer et al. | |
| 5,964,009 | A | | 10/1999 | Hoepfl et al. | |
| 6,108,869 | A | * | 8/2000 | Meessmann et al. | 16/430 |
| 6,128,808 | A | * | 10/2000 | Jansson et al. | 16/431 |
| 6,131,972 | A | * | 10/2000 | Whitehead et al. | 294/57 |
| 6,296,409 | B1 | * | 10/2001 | Cherry et al. | 401/6 |
| 6,305,052 | B1 | * | 10/2001 | Sinclair | 16/430 |
| 6,405,616 | B1 | | 6/2002 | Chen | |
| 6,418,820 | B1 | | 7/2002 | Lamond et al. | |

FOREIGN PATENT DOCUMENTS

| | | | | | |
|---|---|---|---|---|---|
| DE | 4022884 | A1 | * | 1/1992 | B65D/1/24 |
| DE | 29720608 | U1 | * | 2/1998 | B25B/23/16 |
| EP | 0 369 159 | A | | 5/1990 | |
| EP | 0 551 858 | A2 | | 7/1993 | |
| FR | 2635998 | A | * | 3/1990 | B25B/15/02 |
| FR | 2736296 | A3 | * | 1/1997 | B25G/1/10 |
| GB | 2 217 957 | | | 11/1989 | |
| JP | 08067286 | A | * | 3/1996 | B62K/23/00 |
| JP | 10296661 | A | * | 11/1998 | B25G/1/10 |

* cited by examiner

*Primary Examiner*—Chuck Y. Mah
(74) *Attorney, Agent, or Firm*—Brij K. Agarwal; Eckert Seamens Cherin & Mellott, LLC

(57) ABSTRACT

An improved tool handle for a resulting tool is configured to be of an ergonomic cross section, such as a rounded triangle or a teardrop. The improved tool handle may include a core of glass strands within a plastic binder, as well as a coating formed over the core that resists penetration of glass strands therethrough. The coating of such a tool handle may be formed of two separate materials of two durometer hardness in order to provide both a relatively hard grip region and a relatively soft grip region that are contiguous. Such a tool handle may additionally include texturing such as knurling on the harder grip region.

37 Claims, 4 Drawing Sheets

DUAL MATERIAL TOOL HANDLE

BACKGROUND OF THE INVENTION

1. Field of the Invention

The present invention relates generally to tools and, more particularly, to a tool handle.

2. Description of the Related Art

Numerous types of manually-employed tools are known in the relevant art. At least one type of manually-employed tool includes a handle that can be held by a user and an implement mounted on the handle, typically at one end thereof. Such manually employed tools include, for example, shovels, rakes, hoes, picks, as well as other tools.

The handles for such tools have been made of wood, fiberglass materials, plastic, and other materials. Such handles also have typically been substantially round in cross section. While such tool handles have been generally effective for their intended purposes, such tool handles have not, however, been without limitation.

Since wood is a natural material, wooden tool handles have been known to break or otherwise fail during use. Fiberglass materials do not typically break during use, but it is known that such fiberglass handles have a tendency to fatigue during use, with the result that glass fibers can become exposed, which can cause injury to the user if such exposed glass fibers penetrate the skin. Plastic handles are limited in their application due to the limited strength afforded by many plastics. It is thus desired to provide an improved tool handle that has the strength and durability of fiberglass materials without the potential for glass fibers to penetrate the skin of the user.

It is also known that round tool handles can be somewhat uncomfortable to use for extended periods of time. Discomfort can result both to experienced workers who must use a tool for periods of eight hours or more as well as to relatively inexperienced users who use a tool for, say, an hour. Wood is relatively expensive to form in cross sections other than round, and man-made materials have the aforementioned shortcomings when employed to form tool handles. It is thus desired to provide an improved tool handle having an ergonomic shape and that is neither too expensive to manufacture nor potentially injurious to a user. Such an improved tool handle and resulting tool might advantageously be configured to provide for an improved grip by a user.

SUMMARY OF THE INVENTION

An improved tool handle and resulting tool meet and exceed these and other needs, as set forth below. An improved tool handle for a resulting tool is configured to be of an ergonomic cross section, such as a rounded triangle or a teardrop. The improved tool handle may include a core of glass strands within a plastic binder, as well as a coating formed over the core that resists penetration of glass strands therethrough. The coating of such a tool handle may be formed of two separate materials of two durometer hardness in order to provide both a relatively hard grip region and a relatively soft grip region that are contiguous. Such a tool handle may additionally include texturing such as knurling on the harder grip region.

An aspect of the invention is to provide an improved tool handle having an improved ergonomic shape.

Another aspect of the present invention is to provide an improved tool handle having an improved grip surface.

Another aspect of the present invention is to provide an improved tool handle having a hard grip surface as well as a soft grip surface that are generally adjacent one another.

Another aspect of the present invention is to provide an improved tool handle having a core including fiber strands, with a coating being formed over the core that resists penetration of the strands therethrough.

Another aspect of the present invention is to provide an improved tool handle having a generally rounded cross section.

Another aspect of the present invention is to provide a tool handle having a generally teardrop-shaped cross section.

Another aspect of the present invention is to provide an improved tool handle having texturing on an exterior surface thereof to improve grip by a user.

Accordingly, an aspect of the present invention is to provide an elongated handle for a tool, in which the general nature of the handle can be stated as including a core, a coating disposed on the core, the coating including a first portion and a second portion, the first portion being of a first material, the second portion being of a second material, the first portion being disposed on a first region of the core, the second portion being disposed on a second region of the core, the first material being of a first hardness, the second material being of a second hardness, and the first hardness being different than the second hardness.

Another aspect of the present invention is to provide an elongated handle for a tool, in which the general nature of the handle can be stated as including a core, the core including a plurality of fibers and a binder, a coating disposed on the core, the coating having an interior surface and an exterior surface, the interior surface being disposed against the core, and the coating being structured to resist penetration of the fibers through the exterior surface.

Another aspect of the present invention is to provide an elongated handle, the general nature of which can be stated as being in cross section of a generally rounded triangle shape, the generally rounded triangle shape including a first arc, a second arc, and a third arc connected generally end-to-end.

Another aspect of the present invention is to provide an elongated handle, the general nature of which can be stated as being in cross section of a generally rounded teardrop shape, the generally rounded teardrop shape including a first arc, a pair of second arcs, and a third arc, first and third arcs each being connected with both of the second arcs, whereby the second arcs extend generally between the first and third arcs.

Still another aspect of the present invention is to provide a manually-employed tool, the general nature of which can be stated as including an elongated handle and an implement mounted on the handle, the handle including a core and a coating, the coating being disposed on the core, the coating including a first portion and a second portion, the first portion being of a first material, the second portion being of a second material, the first portion being disposed on a first region of the core, the second portion being disposed on a second region of the core, the first material being of a first hardness, the second material being of a second hardness, and the first hardness being different than the second hardness.

BRIEF DESCRIPTION OF THE DRAWINGS

A further understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

Figure 1:
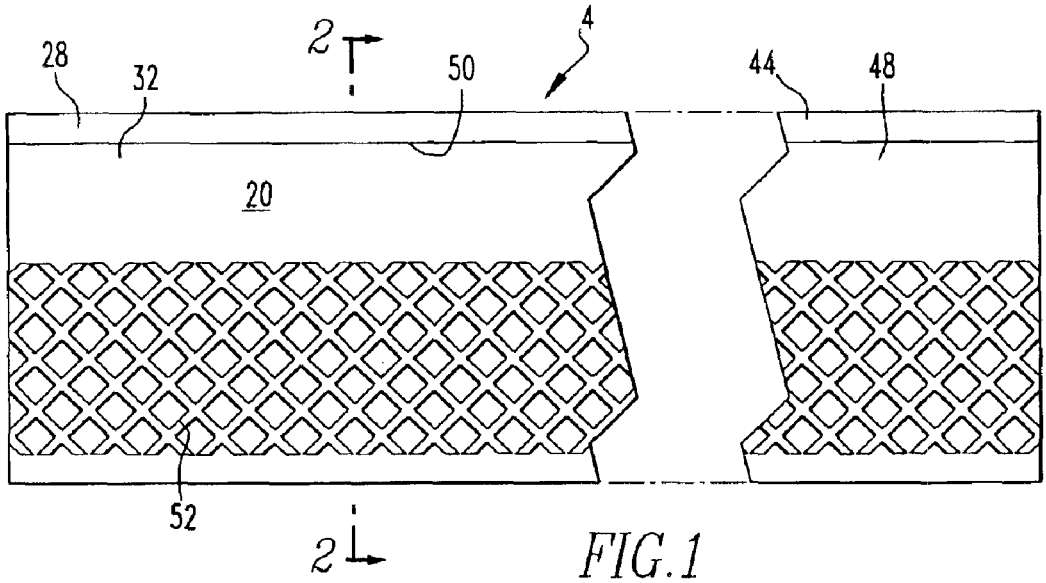
FIG. 1 is a fractional side elevational view of an improved handle in accordance with a first embodiment of the present invention.
Figure 2:
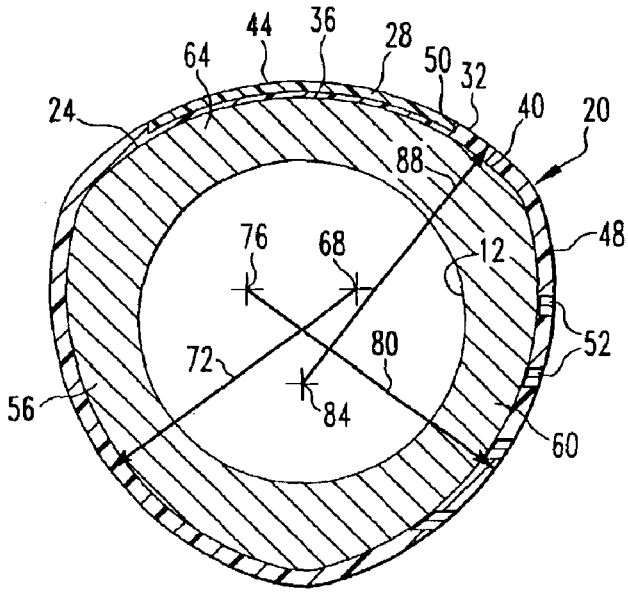
FIG. 2 is a cross sectional view as taken along line 2—2 of FIG. 1.
Figure 3:
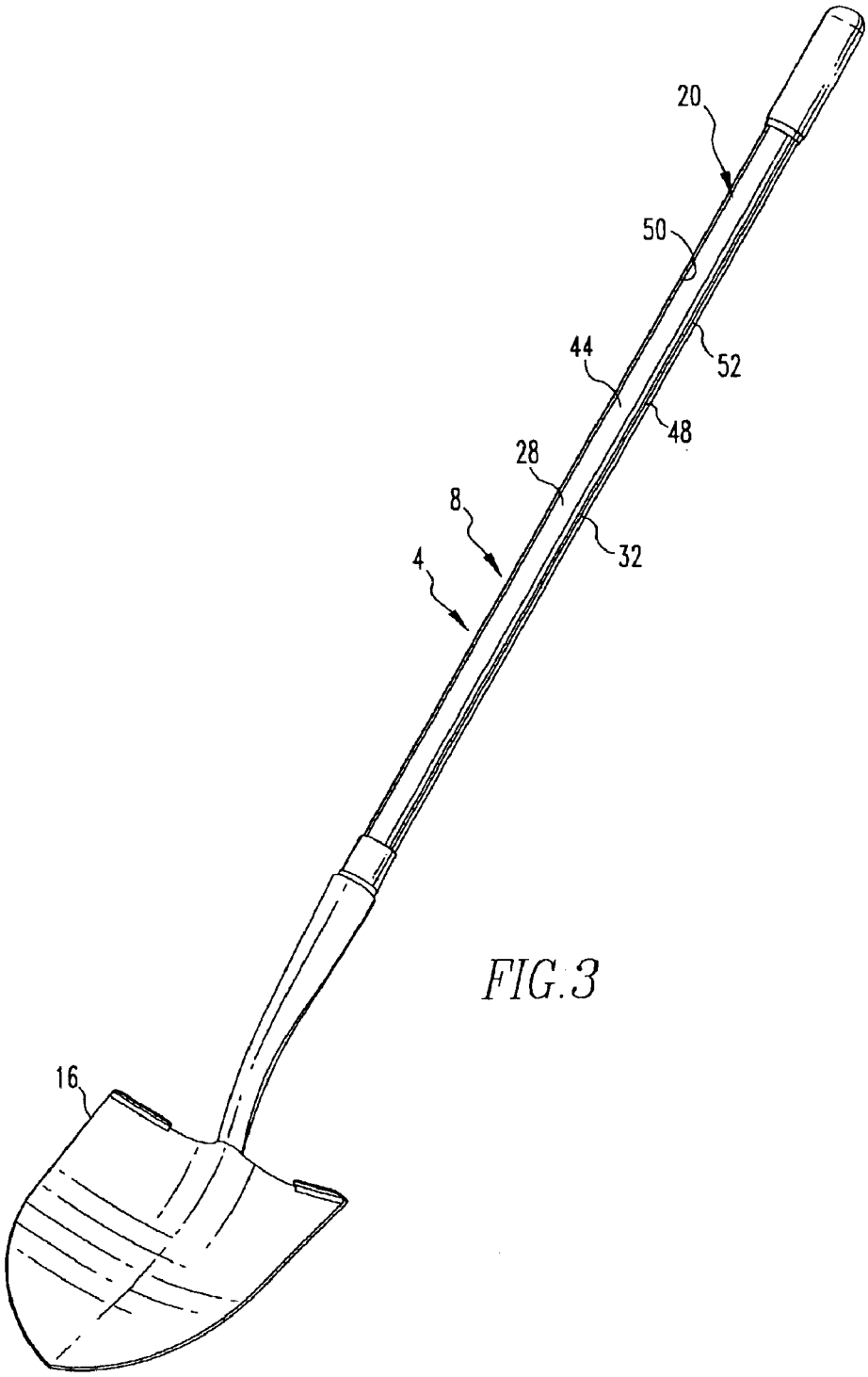
FIG. 3 is a perspective view of a tool in accordance with the present invention incorporating the handle of the first embodiment.
Figure 4:
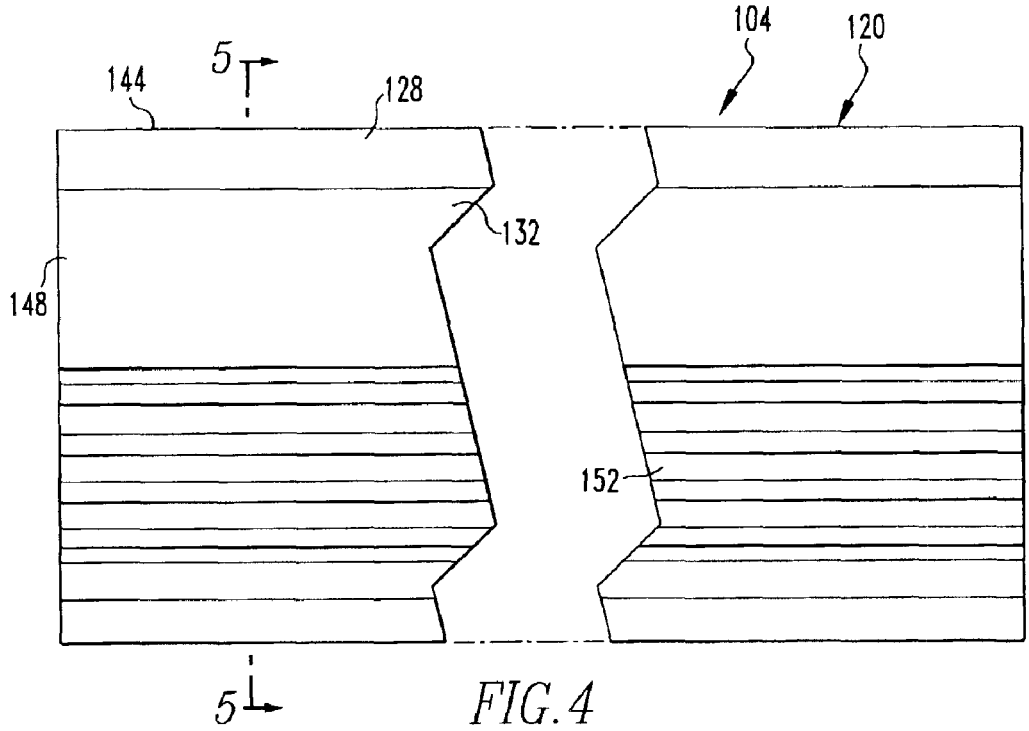
FIG. 4 is a fractional side elevational view of an improved handle in accordance with a second embodiment of the present invention.

An improved handle 4 in accordance with a first embodiment of the present invention in indicated generally in FIGS. 1–3. As is best shown in FIG. 3, the handle 4 can be incorporated into a tool 8 in accordance with the present invention. Specifically, the tool 8 can be generally stated as including the handle 4 plus an implement 16 mounted on an end of the handle 4. The implement 16 is depicted as being a head of a shovel, but it is understood that other implements may be mounted on the handle 4 to form the tool 8. As used herein, the expression "tool" and variations thereof shall be broadly construed to include generally any type of structure that employs a handle, and thus can include ships that might employ a handle in the ship's wheel, an automobile employing a handle in a door, machinery employing a handle, and substantially any other structure that employs handles. As will be set forth more fully below, the handle 4 and the resulting tool 8 have improved ergonomics and other features.

As can be best understood from FIGS. 1 and 2, the handle 4 is an elongated member that includes an elongated core 12 and a coating 20. The core is a hollow member having an outer surface 24, with the coating 20 being disposed on substantially the entirety of the outer surface. The core 12 may be formed of a plurality of elongated strands of fibers such as glass, carbon, aramid, and the like that are disposed within a binder material that may be a polypropylene material or other plastic-type material. The core 12 may be of other materials without departing from the concept of the present invention. The coating 20 is advantageously configured to resist the fibers of the core from penetrating therethrough as a result of fatiguing of the core 12.

The coating 20 includes a first portion 28 made of a first material and a second portion 32 made of a second material. The outer surface 24 of the core 12 can be seen as including a first region 36 and second region 40 that are generally adjacent one another and may be contiguous. The first portion 28 is disposed on the first region 36, and the second portion 32 is disposed on the second region 40. The first portion 28 includes a first external surface 44 opposite the outer surface 24 of the core 12, and the second portion 32 includes a second external surface 48 opposite the outer surface 24 of the core 12. The first and second portions 28 and 32 are disposed generally adjacent one another and may be contiguous.

In accordance with the present invention, the first and second materials are advantageously of different durometer hardness ratings. Specifically, the first material has a relatively lower durometer hardness, and the second material has a relatively higher durometer hardness. As is understood in the relevant art, a durometer is a device which measures the hardness of a material on any of a variety of scales such as the known Rockwell hardness scales, the Shore hardness scales, the Brinell hardness scales, and thus can be of numerous different configurations based upon the standards for testing on such scales. Accordingly, the expression "durometer hardness" refers to a material's hardness as measured by a durometer, and may be expressed as an absolute value or as a relative value.

The first external surface 44 of the first portion 28 feels relatively soft to a user, and the second external surface 48 of the second portion 32 feels relatively hard. The relatively softer first external surface 44 enhances the ability of a user to grasp the handle 4 because a user's hand can deform the first portion 28 to a greater degree than the second portion 32 upon the application of a given force. The first portion 28 likely will also have greater coefficients of static and dynamic friction than the second portion 32, although this need not necessarily be the case. The difference in the durometer hardnesses of the first and second external surfaces 44 and 48 of the first and second portions 28 and 32, respectively, additionally provides an overall more complex tactile feel to a user than would a handle having only a single durometer hardness, with the result that a user can use the handle 4 for a relatively greater period of time before fatigue and numbness require the user to take a break from using the handle 4. The first portion 28 may, for instance, be formed of a TPE material having, for instance, a durometer hardness of 75 on the Shore "A" scale, although other materials and hardness can be employed. The second portion 32 may, for instance, be manufactured of a polypropylene material and may, for instance, have a durometer hardness of 88 on the Rockwell "R" scale, although other materials and hardness may be employed.

The first and second portions 28 and 32 are depicted in FIGS. 1–3 as being adjacent one another and being contiguous along a junction line 50. In other embodiments, however, it may be possible or desirable to adjoin the first and second regions 36 and 40 along a transition region of varying durometer hardness to further improve the feel of the handle 4. Alternatively, it may be desirable to space the first and second portions 28 and 32 away from one another. It is thus understood that the specific locations of the first and second portions of 28 and 32, as well as the relative proportions of the outer surface 24 that the first and second portions 28 and 32 cover can be varied to suit the specific needs of the particular application.

As can further be seen in FIGS. 1 and 2, the second external surface 48 may include texturing 52 such as, for example, knurling. It is understood that the texturing 52 is schematically depicted in FIGS. 1 and 2. Such texturing 52 further enhances the grip between the handle 4 and a user's hand. It is understood that the first external surface 44 may additionally or alternatively include texturing.

As is best understood from FIG. 2, the handle 4 has a cross sectional shape that can be best described as being a rounded triangle. Specifically, the handle 4 in cross section can be seen as including a first arc 56, a second arc 60, and a third arc 64 connected with one another in a generally end to end fashion. More specifically, the lines of connection between the first, second, and third arcs 56, 60, and 64 are radiused to avoid sharp edges on the external surface of the handle 4. As used herein, the first, second, and third arcs 56, 60, and 64 of the handle 4 each include a sector of the core 12 along with its associated portion of the coating 20. As can further be understood from FIG. 2, the external surface of the portion of the coating 20 of the first arc 56 is of a generally fixed radius 72 measured from a first center 68. Similarly, the external surface of the portion of the coating 20 of the second arc 60 is of a generally fixed second radius 80 measured from a second center 76. Likewise, the external surface of the portion of the coating 20 of the third arc 74 is of a generally fixed third radius 88 extending from a third center 84.

In the exemplary handle 4 of FIG. 2, the first and second radii 72 and 80 are substantially equal to one another. The first and second radii 72 and 80 are depicted as being equal to the third radius 88, although it is understood that in other embodiments (not shown) such a relationship may not exist. Moreover, the first, second, and third centers 68, 76, and 84 are each spaced from one another, and the first, second, and third centers, 68, 76, and 84 together define the corners of a triangle, such as an isosceles triangle or an equilateral triangle. Again, such a specific relationship may not exist in other embodiments (not shown).

It has been determined that the generally rounded triangle shape of the handle 4 in cross section is relatively more comfortable in a user's hand for a prolonged period of time than other known cross sectional shapes, such as round shapes. Moreover, the first portion 28 can be oriented on the handle 4 in such a position to maximize comfort of the user during use of the tool 8. For instance, the exemplary tool 8 is depicted as being a shovel, which can be considered to be a prying tool. Specifically, a shovel is often used by stepping on an appropriate step surface of the shovel to push the shovel implement into, say, the ground, with the handle 4 thereafter being pivoted toward the user to pry away a portion of the ground. The first portion 28 can be oriented such that the prying force is primarily applied to the relatively softer first portion 28, which increases the comfort of the user. In this regard, it is understood that the handle 4 could include a plurality of strategically located first portions 28 depending upon the forces that are anticipated to be applied to the handle 4 based upon the specific implement 16 mounted thereon.

While the coating 20 is depicted in FIG. 1 as being of substantially the same thickness across the entirety of the outer surface 24, it is understood that the thickness of the coating 20 may vary as needed. For instance, the first portion 28 may be relatively thicker than the second portion 32. Such variation in thickness can be provided in a number of ways including providing a smooth transition between thickness or a step transition in such thicknesses.

An improved handle 104 in accordance with a second embodiment of the present invention is indicated generally in FIGS. 3–6. The handle 104 can similarly be employed in an improved tool 108 in accordance with the present invention. The tool 108 includes an implement 116 mounted on an end of the handle 104. As can be seen from FIG. 6, the exemplary tool 108 is a rake, although it could be other tools, as explained above.

The handle 104 is similar to the handle 4 in that it includes a core 112 and a coating 120, with the coating 120 being disposed on an outer surface 124 of the core 112 and including a first portion 128 made of a first material and a second portion 132 made of a second material. The first portion 128 is disposed on a first region 136 of the outer surface 124, and the second portion 132 is disposed on a second region 140 of the outer surface 124.

The second material is relatively harder than the first material and thus has a higher durometer hardness than the first material. Accordingly, the first portion 128 includes a first external surface 144 that is relatively softer than a second external surface 148 of the second portion 132. The relative durometer hardnesses may be on the same hardness scale or on different scales. The first and second materials may be the same as those set forth above or may be different without departing from the concept of the present invention. The first and second portions 128 and 132 are disposed substantially adjacent one another and are contiguous such that the first and second external surfaces 144 and 148 provide a substantially contiguous external surface of the tool 108. The second external surface 148 may include texturing 152 such as ribbing or knurling, and additionally or alternatively the first external surface 144 may be textured.

Figure 5:
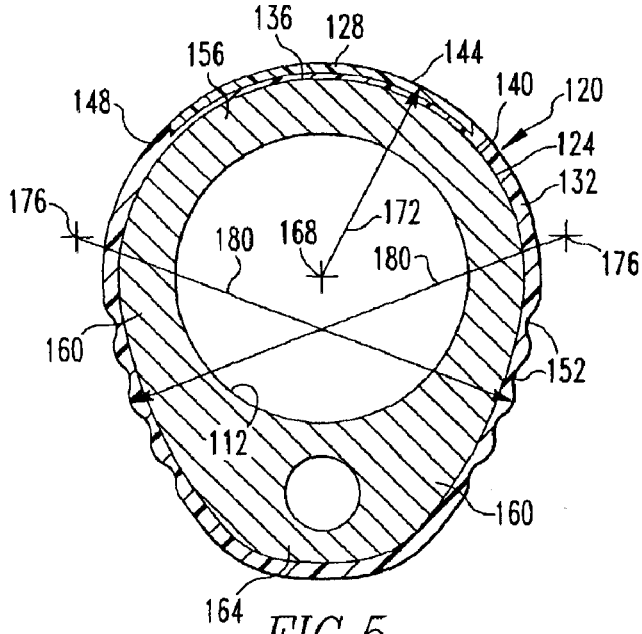
FIG. 5 is cross sectional view as taken along line 5—5 of FIG. 4.
Figure 6:
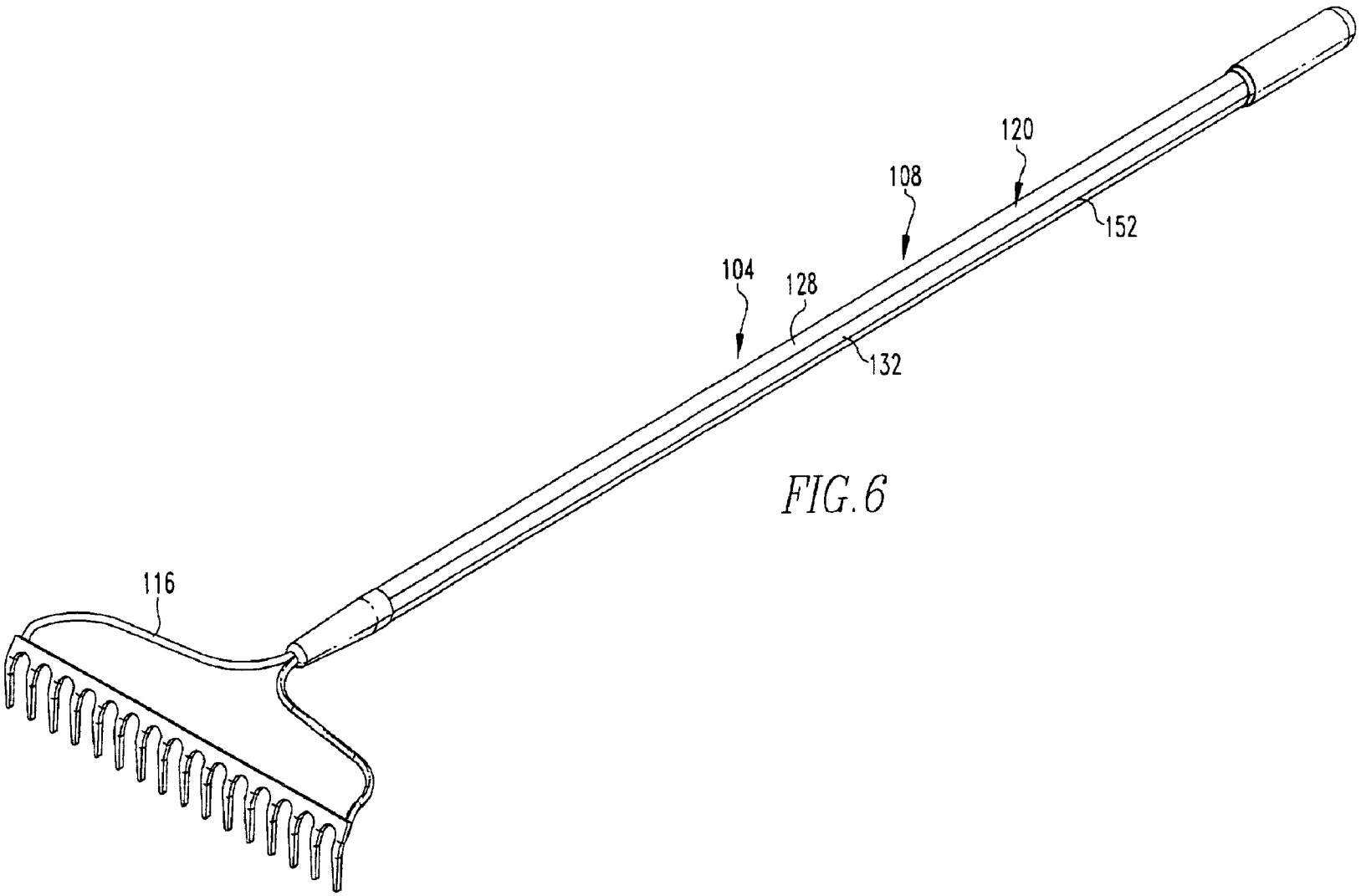
FIG. 6 is a perspective view of a tool in accordance with the present invention incorporating the handle in accordance with the second embodiment.

The handle 104 is different, however, in that it is of a generally teardrop shaped configuration in cross section. As is best shown in FIG. 5, the handle 104 in cross section includes a first arc 156, a pair of second arcs 160, and a connecting portion 164. The first arc 156 and the connecting portion 164 are connected with both of the second arcs 160, whereby the second arcs 160 each extend generally between the first arc 156 and the connecting portion 164. The regions of connection between the first and second arcs 156 and 160 and the connecting portion 164 are radiused in order to avoid the exterior surface of the coating 120 from having any sharp edges.

The first and second arcs 156 and 160 and the connecting portion 164 together give the handle 104 its generally teardrop-shaped cross section. It can be seen that the external surface of the portion of the coating 120 of the first arc 156 is of a substantially fixed first radius 172 from a first center 168. Each external surface of the portion of the coating 120 of each arc 160 includes a generally fixed second radius 180 taken from a second center 176, with the second radii 180 being of substantially the same length. The external surface of the portion of the coating 120 of the connecting portion 164 is flat, but may be arcuate in other embodiments (not shown). The first radius 172 and the second radii 180 are of different lengths.

The handle 104 is depicted as including the first portion 128 along the first arc 156. In this regard, the first arc 156, with the included first portion 128 may be the sector of the handle 104 against which the user presses when using the tool 108. The handle 104 and the resulting tool 108 provide benefits similar to the handle 4 and the resulting tool 8. The handle 104 is of a generally teardrop shaped cross section instead of a generally rounded triangle cross section in order to enable the handle 104 to be suited to application in slightly different tools than the handle 4.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An elongated handle for a tool, the handle comprising:

a core;

a coating disposed on the core;

the coating including a first portion and a second portion;

the first portion being of a first material;

the second portion being of a second material;

the first portion being disposed on a first region of the core;

the second portion being disposed on a second region of the core;

the first material being of a first hardness;

the second material being of a second hardness; and the first hardness being different than the second hardness.

2. The handle as set forth in claim 1, in which the first portion is textured.

3. The handle as set forth in claim 1, in which the core includes a plurality of fibers and a binder;

the coating being structured to resist penetration of the fibers therethrough.

4. The handle as set forth in claim 1, in which the handle in cross section is of a generally rounded triangle shape.

5. The handle as set forth in claim 4, in which the generally rounded triangle shape includes a first arc, a second arc, and a third arc connected generally end-to-end.

6. The handle as set forth in claim 5, in which the first arc has a first center and a first radius, the second arc has a second center and a second radius, and third arc has a third center and a third radius, the relationship among the first, second, and third centers and radii including at least one of:

at least two of the first, second, and third radii being of unequal lengths; and at least two of the first, second, and third centers being spaced apart from one another.

7. The handle as set forth in claim 1, in which the handle in cross section is of a generally rounded teardrop shape.

8. The handle as set forth in claim 7, in which the generally rounded teardrop shape includes a first arc, a pair of second arcs, and a connecting portion, the first arc and the connecting portion each being connected with both of the second arcs, whereby the second arcs each extend generally between the first arc and the connecting portion.

9. The handle as set forth in claim 8, in which the second arcs are each of a radius and have a center;

the radii being of substantially the same length;

the centers being spaced apart from one another.

10. An elongated handle for a tool, the handle comprising:

a core;

the core including a plurality of fibers and a binder;

a coating disposed on the core;

the coating having an interior surface and an exterior surface, the interior surface being disposed against the core; and the coating being structured to resist penetration of the fibers through the exterior surface;

the coating including a first portion and a second portion;

the first portion being of a first material;

the second portion being of a second material;

the first portion being disposed on a first region of the core;

the second portion being disposed on a second region of the core;

the first material being of a first hardness;

the second material being of a second hardness; and the first hardness being different than the second hardness.

11. The handle as set forth in claim 10, in which at least a portion of the coating is textured.

12. The handle as set forth in claim 11, in which the at least a portion of the coating includes knurling.

13. The handle as set forth in claim 10, in which the handle in cross section is of a generally rounded triangle shape.

14. The handle as set forth in claim 13, in which the generally rounded triangle shape includes a first arc, a second arc, and a third arc connected generally end-to-end.

15. The handle as set forth in claim 14, in which the first arc has a first center and a first radius, the second arc has a second center and a second radius, and third arc has a third center and a third radius, the relationship among the first, second, and third centers and radii including at least one of:

at least two of the first, second, and third radii being of unequal lengths; and at least two of the first, second, and third centers being spaced apart from one another.

16. The handle as set forth in claim 10, in which the handle in cross section is of a generally rounded teardrop shape.

17. The handle as set forth in claim 16, in which the generally rounded teardrop shape includes a first arc, a pair of second arcs, and a connecting portion, the first arc and the connecting portion each being connected with both of the second arcs, whereby the second arcs each extend generally between the first arc and the connecting portion.

18. The handle as set forth in claim 17, in which the second arcs are each of a radius and have a center;

the radii being of substantially the same length;

the centers being spaced apart from one another.

19. An elongated handle for a tool, the handle being in cross section of a generally rounded triangle shape, the generally rounded triangle shape including a first arc, a second arc, and a third arc connected generally end-to-end;

the handle including a core and a coating;

the coating being disposed on the core;

the coating including a first portion and a second portion;

the first portion being of a first material;

the second portion being of a second material;

the first portion being disposed on a first region of the core;

the second portion being disposed on a second region of the core;

the first material being of a first hardness;

the second material being of a second hardness; and the first hardness being different than the second hardness.

20. The handle as set forth in claim 19, in which the first arc has a first center and a first radius, the second arc has a second center and a second radius, and third arc has a third center and a third radius, the relationship among the first, second, and third centers and radii including at least one of:

at least two of the first, second, and third radii being of unequal lengths; and at least two of the first, second, and third centers being spaced apart from one another.

21. The handle as set forth in claim 19, in which at least a portion of the coating is textured.

22. The handle as set forth in claim 21, in which the at least a portion of the coating includes knurling.

23. The handle as set forth in claim 19, in which the core includes a plurality of fibers and a binder; the coating being structured to resist penetration of the fibers therethrough.

24. An elongated handle for a tool, the handle being in cross section of a generally rounded teardrop shape, the generally rounded teardrop shape including a first arc, a pair of second arcs, and a connecting portion, the first arc and the connecting portion each being connected with both of the second arcs, whereby the second arcs each extend generally between the first arc and the connecting portion;

the handle including a core and a coating;

the coating being disposed on the core;

the coating including a first portion and a second portion;

the first portion being of a first material;

the second portion being of a second material;

the first portion being disposed on a first region of the core;

the second portion being disposed on a second region of the core;

the first material being of a first hardness;

the second material being of a second hardness; and the first hardness being different than the second hardness.

25. The handle as set forth in claim 24, in which the second arcs are each of a radius and have a center;

the radii being of substantially the same length;

the centers being spaced apart from one another.

26. The handle as set forth in claim 24, in which at least a portion of the coating;

is textured.

27. The handle as set forth in claim 26, in which the at least a portion of the coating includes knurling.

28. The handle as set forth in claim 24, in which the core includes a plurality of fibers and a binder;

the coating being structured to resist penetration of the fibers therethrough.

29. A manually-employed tool comprising:

an elongated handle; and an implement mounted on the handle;

the handle including a core and a coating, the coating being disposed on the core;

the coating including a first portion and a second portion;

the first portion being of a first material;

the second portion being of a second material;

the first portion being disposed on a first region of the core;

the second portion being disposed on a second region of the core;

the first material being of a first hardness;

the second material being of a second hardness; and the first hardness being different than the second hardness.

30. The tool as set forth in claim 29, in which the first portion is textured.

31. The tool as set forth in claim 29, in which the core includes a plurality of fibers and a binder;

the coating being structured to resist penetration of the fibers therethrough.

32. The tool as set forth in claim 29, in which the handle in cross section is of a generally rounded triangle shape.

33. The tool as set forth in claim 32, in which the generally rounded triangle shape includes a first arc, a second arc, and a third arc connected generally end-to-end.

34. The tool as set forth in claim 33, in which the first arc has a first center and a first radius, the second arc has a second center and a second radius, and third arc has a third center and a third radius, the relationship among the first, second, and third centers and radii including at least one of:

at least two of the first, second, and third radii being of unequal lengths; and at least two of the first, second, and third centers being spaced apart from one another.

35. The tool as set forth in claim 29, in which the handle in cross section is of a generally rounded teardrop shape.

36. The tool as set forth in claim 35, in which the generally rounded teardrop shape includes a first arc, a pair of second arcs, and a connecting portion, the first arc and the connecting portion each being connected with both of the second arcs, whereby the second arcs each extend generally between the first arc and the connecting portion.

37. The tool as set forth in claim 36, in which the second arcs are each of a radius and have a center;

the radii being of substantially the same length;

the centers being spaced apart from one another.

* * * * *

UNITED STATES PATENT AND TRADEMARK OFFICE

CERTIFICATE OF CORRECTION

PATENT NO. : 6,889,405 B2
DATED : May 10, 2005
INVENTOR(S) : Michael L. Ritrovato et al.

It is certified that error appears in the above-identified patent and that said Letters Patent is hereby corrected as shown below:

Title page,
Item [74], *Attorney, Agent, or Firm*, "Seamens" should read -- Seamans --.

Column 9,
Line 12, start new paragraph with "the coating being…".
Line 39, remove the ";" after "coating".

Signed and Sealed this

Sixth Day of September, 2005

JON W. DUDAS
*Director of the United States Patent and Trademark Office*